US007556015B2

(12) United States Patent
Staffend

(10) Patent No.: US 7,556,015 B2
(45) Date of Patent: Jul. 7, 2009

(54) ROTARY DEVICE FOR USE IN AN ENGINE

(76) Inventor: Gilbert S. Staffend, 24093 Tana Ct., Farmington, MI (US) 48335-3401

( * ) Notice: Subject to any disclaimer, the term of this patent is extended or adjusted under 35 U.S.C. 154(b) by 723 days.

(21) Appl. No.: 11/133,824

(22) Filed: May 20, 2005

(65) Prior Publication Data

US 2005/0260091 A1 Nov. 24, 2005

Related U.S. Application Data

(60) Provisional application No. 60/572,706, filed on May 20, 2004.

(51) Int. Cl.
*F02B 53/04* (2006.01)

(52) U.S. Cl. ..... 123/221; 123/223; 123/231

(58) Field of Classification Search ..... 123/221, 123/223, 131, 312
See application file for complete search history.

(56) References Cited

U.S. PATENT DOCUMENTS

| | | | |
|---|---|---|---|
| 631,815 | A | 8/1899 | Pratt |
| 1,016,764 | A | 2/1912 | Noyes |
| 1,228,806 | A | 6/1917 | Morris |
| 1,249,881 | A | 12/1917 | Anglada |
| 1,307,282 | A | 6/1919 | Ward |
| 1,349,353 | A | 8/1920 | Wilber, Jr. |
| 1,478,378 | A | 12/1923 | Brown |
| 1,493,826 | A | 5/1924 | Small |
| 1,602,018 | A | 10/1926 | Harvey |
| 1,684,254 | A | 9/1928 | Bailey |
| 1,859,618 | A | 5/1932 | Cleland |
| 2,036,060 | A | 3/1936 | Lewis |
| 2,048,825 | A | 7/1936 | Smelser |
| 2,061,049 | A | 11/1936 | Spellman |
| 2,124,542 | A | 7/1938 | Chisolm |
| 2,179,401 | A | 11/1939 | Chkliar |
| 2,214,833 | A | 9/1940 | Hocker, Jr. |
| 2,250,484 | A | 7/1941 | Jutting |
| 2,294,647 | A | 9/1942 | Ames |

(Continued)

FOREIGN PATENT DOCUMENTS

| | | | |
|---|---|---|---|
| CA | 2345508 | A1 | 10/2001 |

(Continued)

OTHER PUBLICATIONS

English language Abstract for JP 61-277889 extracted from espacenet.com database dated Jan. 16, 2007.

*Primary Examiner*—Hoang M Nguyen
(74) *Attorney, Agent, or Firm*—Dickinson Wright PLLC

(57) ABSTRACT

A rotary device for an engine includes a stator and a rotor concentric with and rotatable about an axis with respect to the stator. The rotor and the stator cooperate to provide a working chamber. A plurality of vanes are supported for radial movement on one of the stator and the rotor. Fluid is taken into the working chamber through an intake port and exhausted from the working chamber through an exhaust port. A biasing device biases each of the vanes to seal against one of the stator and the rotor. An actuator moves each of the vanes radially against the biasing device to a retracted position to vary a thermodynamic cycle of the rotary device as the rotor rotates with respect to the stator.

41 Claims, 8 Drawing Sheets

U.S. PATENT DOCUMENTS

| | | | | | |
|---|---|---|---|---|---|
| 2,382,591 | A | | 8/1945 | Warren | |
| 2,396,882 | A | | 3/1946 | Rice | |
| 2,409,141 | A | | 10/1946 | Margolis | |
| 2,412,949 | A | * | 12/1946 | Brown et al. | 123/346 |
| 2,420,401 | A | | 5/1947 | Prokofieff | |
| 2,468,451 | A | * | 4/1949 | Kutzner | 123/206 |
| 2,636,480 | A | | 4/1953 | Becker | |
| 2,671,605 | A | | 3/1954 | Grumblatt | |
| 2,728,330 | A | | 12/1955 | Peterson | |
| 2,762,346 | A | | 9/1956 | White | |
| 2,786,421 | A | | 3/1957 | Prendergast | |
| 2,821,176 | A | | 1/1958 | Koser et al. | |
| 3,057,157 | A | | 10/1962 | Close | |
| 3,118,432 | A | | 1/1964 | Peterson | |
| 3,151,806 | A | | 10/1964 | Whitfield | |
| 3,171,391 | A | | 3/1965 | Appleton | |
| 3,276,386 | A | | 10/1966 | Fanshawe | |
| 3,280,804 | A | | 10/1966 | Hellbaum | |
| 3,411,488 | A | | 11/1968 | Kratina | |
| 3,467,070 | A | | 9/1969 | Green | |
| 3,548,790 | A | | 12/1970 | Pitts | |
| 3,568,645 | A | | 3/1971 | Grimm | |
| 3,572,030 | A | | 3/1971 | Cuff | |
| 3,727,589 | A | | 4/1973 | Scott | |
| 3,745,979 | A | | 7/1973 | Williams | |
| 3,780,708 | A | | 12/1973 | Angsten | |
| 3,797,464 | A | | 3/1974 | Abbey | |
| 3,865,085 | A | | 2/1975 | Stenberg | |
| 3,931,810 | A | | 1/1976 | McGathey | |
| 3,964,450 | A | | 6/1976 | Lockshaw | |
| 3,973,525 | A | | 8/1976 | Keylwert | |
| 4,157,011 | A | | 6/1979 | Liddle | |
| 4,169,451 | A | | 10/1979 | Niggemeyer | |
| 4,241,713 | A | | 12/1980 | Crutchfield | |
| 4,362,480 | A | | 12/1982 | Suzuki et al. | |
| 4,492,541 | A | | 1/1985 | Mallen-Herrero et al. | |
| 4,552,107 | A | | 11/1985 | Chen | |
| 4,599,059 | A | | 7/1986 | Hsu | |
| 4,770,084 | A | | 9/1988 | Miwa et al. | |
| 5,056,314 | A | | 10/1991 | Paul et al. | |
| 5,184,526 | A | | 2/1993 | Watanabe | |
| 5,433,179 | A | | 7/1995 | Wittry | |
| 5,494,014 | A | | 2/1996 | Lobb | |
| 5,524,587 | A | | 6/1996 | Mallen et al. | |
| 5,531,197 | A | | 7/1996 | Lobb | |
| 5,595,154 | A | | 1/1997 | Smith | |
| 5,622,149 | A | | 4/1997 | Wittry | |
| 5,640,938 | A | | 6/1997 | Craze | |
| 5,895,210 | A | | 4/1999 | Nakaniwa et al. | |
| 6,015,279 | A | | 1/2000 | Yamane | |
| 6,065,874 | A | | 5/2000 | Tour | |
| 6,125,814 | A | | 10/2000 | Tang | |
| 6,178,633 | B1 | | 1/2001 | Yamane | |
| 6,179,596 | B1 | | 1/2001 | Weisener et al. | |
| 6,227,833 | B1 | | 5/2001 | Froslev et al. | |
| 6,264,451 | B1 | | 7/2001 | Murayama et al. | |
| 6,543,225 | B2 | | 4/2003 | Scuderi | |
| 6,551,083 | B2 | | 4/2003 | Weisener et al. | |
| 6,588,395 | B2 | | 7/2003 | DeFazio | |
| 6,609,371 | B2 | | 8/2003 | Scuderi | |
| 6,643,927 | B2 | | 11/2003 | Murayama et al. | |
| 6,722,127 | B2 | | 4/2004 | Scuderi et al. | |
| 6,880,502 | B2 | | 4/2005 | Scuderi | |
| 6,932,588 | B2 | | 8/2005 | Choi et al. | |
| 6,986,329 | B2 | | 1/2006 | Scuderi et al. | |
| 7,017,536 | B2 | | 3/2006 | Scuderi | |
| 2005/0042077 | A1 | | 2/2005 | Gekht et al. | |

FOREIGN PATENT DOCUMENTS

| | | | |
|---|---|---|---|
| DE | 298 12 323 | U1 | 9/1998 |
| EP | 0416977 | A1 | 3/1991 |
| EP | 1 016 785 | A1 | 7/2000 |
| EP | 0 416 977 | A1 | 5/2006 |
| FR | 713923 | A | 11/1931 |
| JP | 61 277889 | A | 12/1986 |
| WO | WO02/46581 | A1 | 6/2002 |

* cited by examiner

FIG - 1
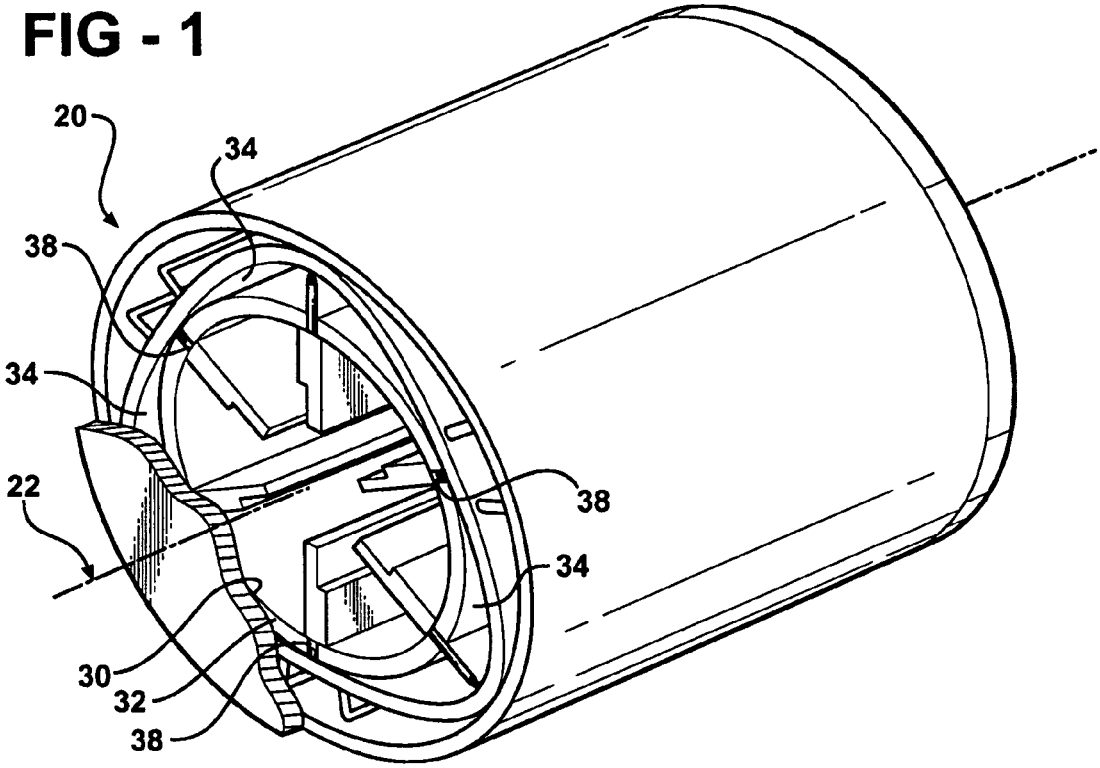
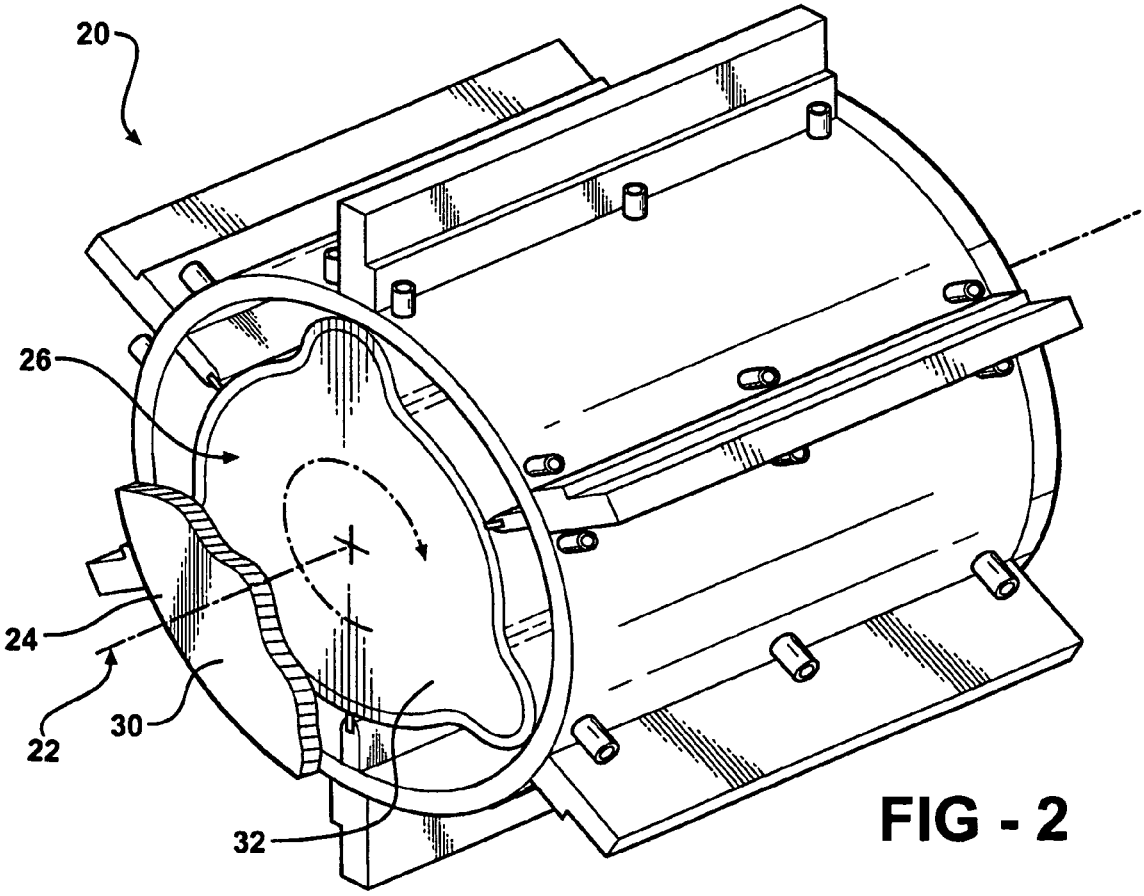
FIG - 2

ROTARY DEVICE FOR USE IN AN ENGINE

CROSS REFERENCE TO RELATED APPLICATION

This application claims the benefit of U.S. Provisional Patent Application Ser. No. 60/572,706 filed May 20, 2004, which is hereby incorporated by reference.

BACKGROUND OF THE INVENTION

1. Field of the Invention

The invention generally relates to a rotary device for use in an engine. More specifically, the invention relates to a rotary engine.

2. Description of the Prior Art

Traditional rotary engines typically have an axis and include a stator on the axis and a rotor on the axis, concentric with and rotatable with respect to, the stator. An example of a rotary engine is disclosed in U.S. Pat. No. 3,780,708 to Angsten (the '708 patent). In the '708 patent, the rotor includes a cylinder and the stator is disposed in the cylinder, allowing the rotor to rotate about the stator. The stator and the cylinder cooperate to provide three working chambers. Six vanes are supported by the stator and are radially biased to seal against the rotor as the rotor rotates about each of the vanes. Each vane is divided into a leading and a trailing side. Additionally, an intake port, an exhaust port, a fuel injection port, and a spark plug are disposed in diametric opposition on the stator. As the working chambers rotate with respect to the stator and the vanes, the trailing side of the vanes draws an air-fuel mixture into one of the working chambers through the intake port as the leading side of the vane compresses the air-fuel mixture that was drawn into the working chamber by the trailing side of the previous vane that the working chamber had already rotated through. The compressed air-fuel mixture is exhausted from the working chamber through a compression exhaust port to a storage chamber. The compressed air-fuel mixture is drawn into another working chamber from the storage chamber along the trailing side of one of the vanes. Next, a spark charge, from the spark plug, ignites the compress air-fuel mixture to expand the air-fuel mixture inside of the working chamber. Following the expansion of the air-fuel mixture, the leading side of the adjacent vane pushes the expanded air-fuel mixture through an exhaust port and out of the rotary engine. Because the vanes are continuously biased against the rotor to provide uninterrupted sealing contact between the vanes and the rotor, the compression ratio and the expansion ratio remain constant throughout the operation of the rotary engine to provide a consistent thermodynamic cycle.

SUMMARY OF THE INVENTION AND ADVANTAGES

The present invention provides a rotary device having an axis for use in an engine. The rotary device includes a stator and a rotor. The stator has a peripheral wall extending about the axis and a pair of oppositely facing stator side walls. The rotor is concentric with and rotatable with respect to the stator. The rotor has a pair of rotor side walls in opposition to the stator side walls and a peripheral wall extending about the axis and opposite the peripheral wall of the stator. The stator walls and the rotor walls cooperate to provide a working chamber. An intake port extends through one of the walls of one of the stator and the rotor for periodically opening to the working chamber to deliver a fluid into the working chamber during the rotor rotation. An exhaust port extends through one of the walls of one of the stator and the rotor for periodically opening to the working chamber to exhaust the fluid from the working chamber during the rotor rotation. A plurality of vanes are spaced a predetermined angle relative to one another about the axis. Each vane is supported for radial movement by one of the stator and the rotor to move radially to maintain sealing contact with the peripheral wall of the other of the stator and the rotor while also contacting the side walls of the other of the stator and the rotor during rotor rotation to sequentially periodically divide the working chamber into leading and trailing sides of the vane relative to the direction of the rotor rotation. The rotary device includes a biasing device for radially moving the vanes to maintain sealing contact between the vanes and the associated peripheral wall during the rotor rotation. The rotary device further includes an actuator responsive to a control signal for moving each of the vanes radially against the biasing device to a retracted position and a control system for sending a signal to each of the actuators to selectively move each of the vanes radially to vary a thermodynamic cycle during each revolution of the rotor.

The present invention also provides a method of operating the rotary device. The method includes the steps of biasing each of the vanes to seal against one of the stator and the rotor, intaking a fluid into the working chamber, rotating the rotor relative to the stator, exhausting the fluid from the working chamber, and moving each of the vanes radially against the biasing device to the retracted position.

Accordingly, it would be advantageous to provide a rotary device with vanes that are selectively, radially retractable. This would allow the compression ratio and/or the expansion ratio within the rotary device to be continuously altered as the rotor rotates to alter the thermodynamic properties of the rotary device as the rotor rotates with respect to the stator. In the simplest versions, the rotary device varies between an Otto cycle and an Ideal cycle. This allows the rotary device to operate in the Ideal cycle when fuel efficiency is desired and to switch to the Otto cycle when more power is required. Because the rotary device provides a mechanical separation of a compression stage from a combustion stage, it allows the rotary device to arbitrarily control a working volume, via radial movement of the vanes, and the pressure of the air introduced into the working chamber, i.e., a combustion chamber. This provides an additional ability to deliver thermodynamic performance of the Ideal Cycle. Performance possibly exceeding the Brayton cycle, found in continuous combustion gas turbine engines, may be configured by combining very high open inlet pressures, with a pulsed fuel delivery, into the combustion chamber.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 1 is a perspective view of a rotary device partially cut away;

FIG. 2 is a perspective view of an alternative embodiment of the rotary device shown in FIG. 1 partially cut away;

DETAILED DESCRIPTION OF THE INVENTION

Figure 3:
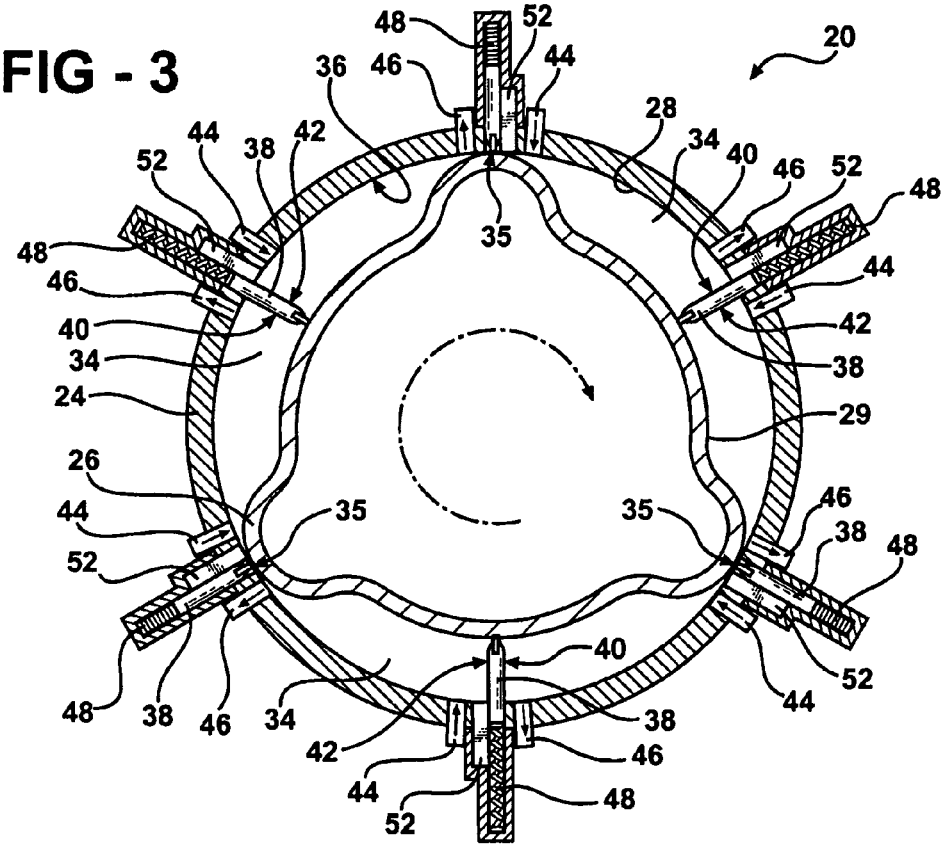
FIG. 3 is a cross-sectional side view of a rotary device having a rotor and a stator surrounding the rotor with ports supported by the stator.

Referring to the Figures, wherein like numerals indicate corresponding parts throughout the several views, a rotary device having an axis 22, for use in an engine, is shown generally at 20. Referring generally for FIGS. 1 and 2, the rotary device 20 includes a stator 24 and a rotor 26. The stator 24 surrounds the rotor 26 on the axis 22. The stator 24 is static and the rotor 26 rotates with respect to the stator 24 on the axis 22. Therefore, the rotor 26 is concentric with, and rotatable with respect to, the stator 24. The stator 24 has a stator peripheral wall 28 extending about the axis 22 and a pair of oppositely facing stator side walls 30. The rotor 26 has a pair of rotor side walls 32 in opposition to the stator side walls 30 and a rotor peripheral wall 29 extending about the axis 22 and opposite the stator peripheral wall 28.

Referring to FIG. 3, the stator 24 includes a cylinder 36, which is also the stator peripheral wall 28, on the axis 22 with the rotor 26 disposed in the cylinder 36 on the axis 22 where the stator walls 28, 30 enclose the rotor 26 inside of the cylinder 36 while allowing the rotor 26 to rotate on the axis 22 in the cylinder 36 relative to the stator 24. The rotor peripheral wall 29 is generally rounded and having peaks 35, angularly spaced along the rotor peripheral wall 29. The stator peripheral wall 28 remains in constant rotational contact with each of the peaks 35 of the rotor peripheral wall 29. Therefore, the stator walls 28, 30 and the rotor walls 29, 32 cooperate to provide a working chamber 34, between each of the adjacent peaks 35. The quantity of working chambers 34 can be any number, based on the number of peaks on the rotor peripheral wall 29.

Figure 4:
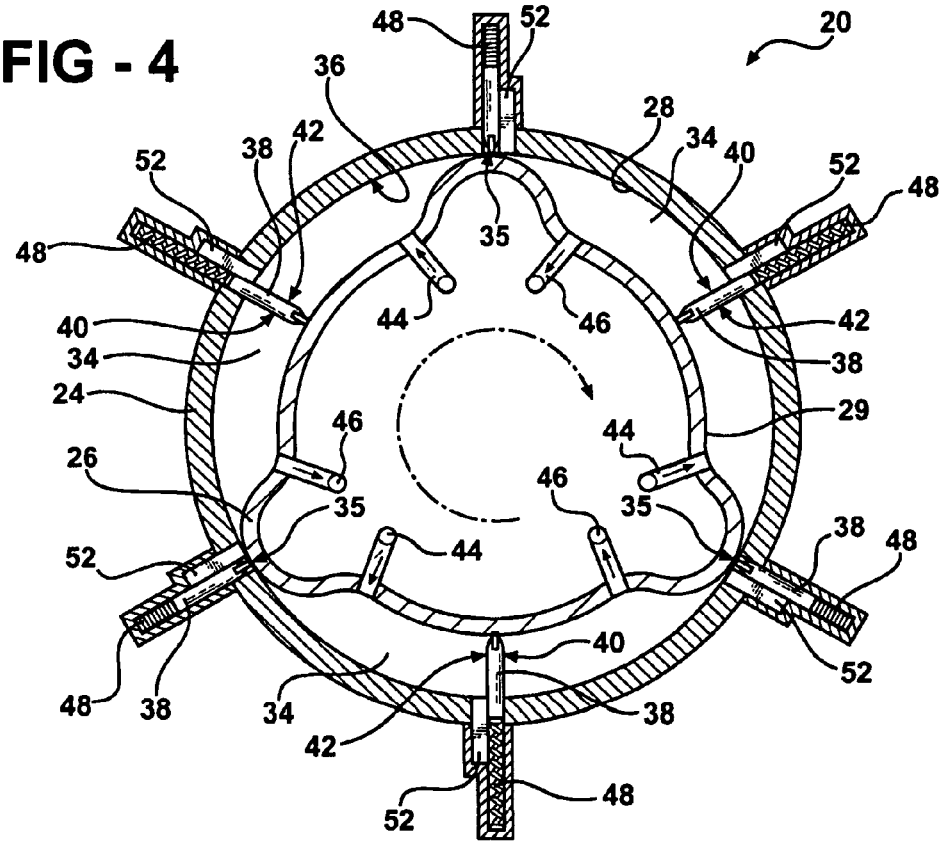
FIG. 4 is a cross-sectional side view of an alternative embodiment of the rotary device shown in FIG. 3 with the ports supported by the rotor.

A plurality of vanes 38 are spaced a predetermined angle relative to one another about the axis 22. Each vane 38 is supported for radial movement by the stator 24 to move radially to maintain sealing contact with the rotor peripheral wall 29 while also contacting the stator side walls 30 during the rotor 26 rotation to sequentially periodically divide each working chamber 34 into leading sides 40 and trailing sides 42 of each vane 38, relative to the direction of the rotor 26 rotation. Additionally, the vanes 38 are angularly spaced to coincide with each working chamber 34, such that there are at least two vanes 38 coinciding with each working chamber 34 at all times during the rotor 26 rotation. Referring to FIG. 3, an intake port 44 extends through the stator peripheral wall 28. The intake port 44 is for periodically opening to the working chamber 34 to deliver a fluid into the working chamber 34 during the rotor 26 rotation, i.e., intaking a fluid into the working chamber 34. Typically, the fluid is air. However, the fluid is not limited to air and can be any other type of acceptable fluid or fluid mixture. The fluid may also include fuel for combusting the fluid. An exhaust port 46 extends through the stator peripheral wall 28. The exhaust port 46 is for periodically opening to the working chamber 34 to exhaust the fluid from the working chamber 34 during the rotor 26 rotation, i.e., exhausting the fluid from the working chamber 34. Generally, the intake port 44 is positioned proximate the trailing side 42 of each vane 38 and the exhaust port 46 is positioned proximate the leading side 40 of the vane 38. However, the ports 44, 46 are not limited to being proximate the vanes 38 and can also extend through the rotor peripheral wall 29, as shown in FIG. 4, inside of the working chamber 34. When the ports 44, 46 extend through the rotor peripheral wall 29, each port is preferably near opposite ends of the working chamber 34, proximate the peaks 35. The relevance of the positioning of the ports 44, 46 relative to the vanes 38, or at opposite ends of the working chamber 34, will be described in more detail below.

The intake and exhaust ports 44, 46 open and close in a number of ways. One way the intake and exhaust ports 44, 46 open and close are when they are dependent on the angular position of the vanes 38. Another way is when the intake and exhaust ports 44, 46 are dependent on the radial position of the vanes 38, i.e., as the vanes 38 move radially as they travel along the rounded shape of the associated peripheral wall 28, 29. When the intake and exhaust ports 44, 46 open and close based on the radial position, they may open and close based moving a shuttle valve, for example, in response to the radial position of the intake and exhaust ports 44, 46. The intake and exhaust ports 44, 46 open and close in response to a control signal. The control signal may be from a computer, but a computer is not required. Additionally, the intake and exhaust ports 44, 46 are not required to open and close as they may also remain in a continuous open position where the intake port 44 continuously take in the fluid and the exhaust port 46 continuously exhausts the fluid.

Figure 12:
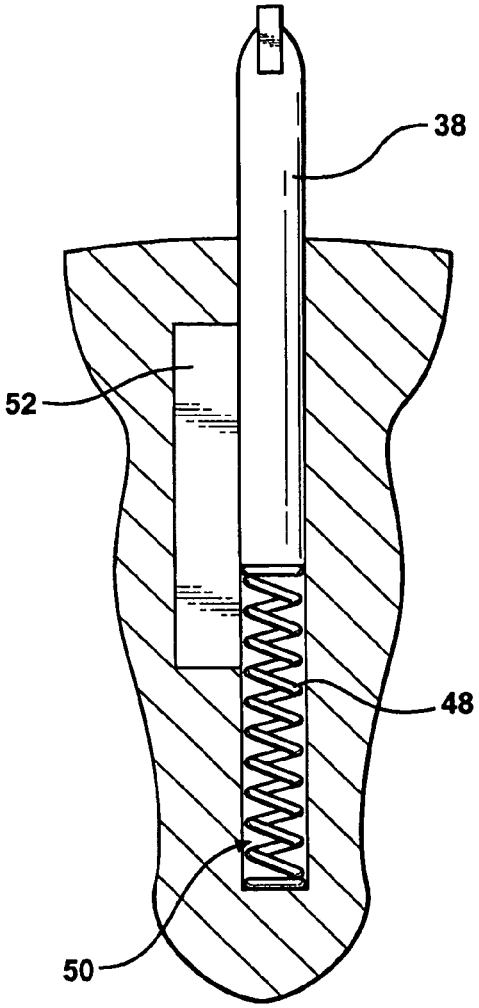
FIG. 12 is a partial cross-sectional side view of a vane biased by a biasing device in an extended position.
Figure 13:
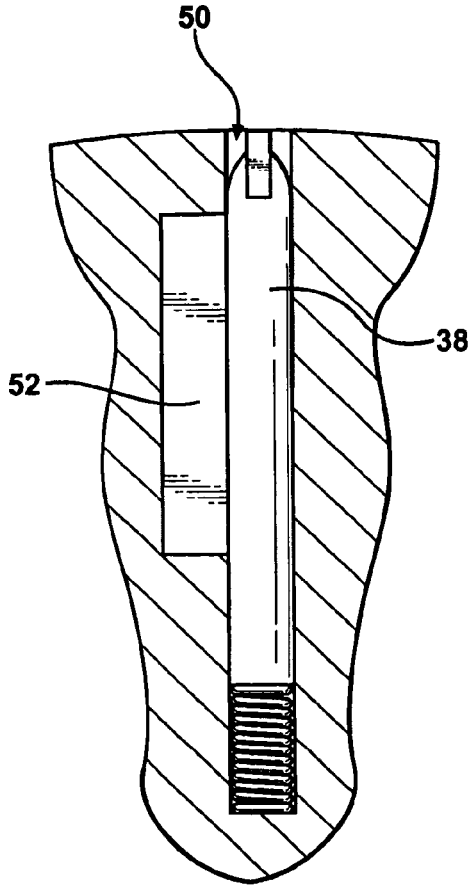
FIG. 13 is a partial cross-sectional view of the vane shown in FIG. 12 retracted by an actuator in a radially retracted position.

The rotary device 20 also includes a biasing device 48 for radially moving the vanes 38, as shown in FIGS. 12 and 13, to maintain sealing contact between the vanes 38 and the rotor peripheral wall 29 during the rotor 26 rotation. The stator 24 defines vane pockets 50 for receiving each of the vanes 38 radially in the retracted position. The biasing device 48 is disposed in each of the pockets 50 for radially moving the vanes 38 out of the pockets 50 to maintain sealing contact between the vanes 38 and the rotor peripheral wall 29 during the rotor 26 rotation, i.e., biasing each of the vanes 38 to seal against the rotor 26, as shown in FIG. 12. The rotary device 20 further includes an actuator 52, responsive to a control signal, for moving each of the vanes 38 radially against, i.e., in opposition to, the biasing device 48 to a retracted position, as shown in FIG. 13. The actuator 52 connects each of the vanes 38 and the stator 24 for moving each of the vanes 38 radially against the biasing device 48 to the retracted position inside of the pockets 50, i.e., moving each of the vanes 38 radially against the biasing device 48 to the retracted position. When the vanes 38 are retracted into the pockets 50, the vanes 38 completely retract out of the working chamber 34 to be at least flush with the rotor peripheral wall 29. Additionally, the rotary device 20 includes a control system for sending the control signal to each of the actuators 52 to selectively move each of the vanes 38 radially to vary a thermodynamic cycle during each revolution of the rotor 26, i.e., selectively moving each of the vanes 38 radially to vary the thermodynamic cycle during each revolution of the rotor 26. The control system is a computer control system for controlling radial movement of the vanes 38 with a computer. The control system includes a plurality of modes of operation for operating in any one of the various thermodynamic cycles.

As the rotor 26 rotates, there is relative movement between the working chambers 34 and the vanes 38. The leading side 40 of the vane 38 is the side 40, 42 that enters the working chamber 34 first. Accordingly, the trailing side 42 of the vane 38 is opposite the leading side 40, which enters the working chamber 34 after the leading side 40. When the trailing side 42 enters the working chamber 34, the associated intake port 44 opens and the fluid enters the working chamber 34, this is an intake stage. As described above, the intake port 44 is proximate the trailing side 42 of the vane 38. A working volume is defined as the volume in the working chamber between the trailing side 42 of one of the vanes and the leading side 40 of the adjacent extended vane 38 to rotate into the working chamber 34. Therefore, if a vane 38 is retracted into the pocket 50, the working volume doubles. If more vanes 38 are retracted, the working volume between the two adjacent vanes 38 is even greater. There is no limit to the number of vanes 38, working chambers 34, and intake and exhaust ports 44, 46 that can be used with the rotary device 20, except the size of the various components and the total volume of the working chambers 34. When the vanes 38 are retracted, the associated intake and exhaust ports 44, 46 are disengaged. However, the disengagement of the intake and exhaust ports 44, 46 are not required. The fluid continues to enter the working chamber 34 from the intake port 44 as the trailing side 42 travels an angularly through the working chamber 34 until the working volume is filled with the fluid. This is an intake stage. An ignition source 54 may be optionally disposed on one of the stator walls 28, 30 or the rotor walls 29, 30. The combustion does not have to be performed within the working chamber 34 of the rotary device 20 and may be performed in a combustion chamber remote from the rotary device 20. Additionally, if the fluid does not already contain a combustible fuel, the rotary device 20 includes a fuel port 56 located on any of the stator walls 28, or the rotor walls 29, 30 for injecting a fuel into the working volume, to mix with the fluid to create an optional fluid-fuel mixture. When the fluid that is drawn into the working volume by the trailing side 42 of the vane 38 through the intake port 44 is a compressed fluid, and the fluid is mixed with fuel to be the fluid-fuel mixture, the ignition source 54 creates a spark to combust the fluid-fuel mixture as the trailing side 42 of the vane 38 rotates through the working chamber 34 to increase the working volume. As the fluid-fuel mixture combusts, while the working volume increases, the combusting fluid-fuel mixture is expanded. This is an expansion stage. During expansion of the fluid-fuel mixture, the greater the working volume that can be achieved, based on the number of vanes 38 that are in the retracted position, i.e., creating a larger angular distance between the adjacent vanes 38 in the extended position, the larger the expansion ratio that can also be achieved. For example, in the simplest rotary device 20, on any given rotor 26 rotation, both the compression ratio and the expansion ratio would be held constant. To illustrate this, assume the rotary device 20 includes one peak 35 and two vanes 38. The number of peaks 35 and vanes 38 may be chosen to suit performance objectives in a ratio of from 1:1 to 1:n, where the number n is limited only be practicalities of packaging. Each of this rotary device's 20 working chambers 34 would be capable of compressing a volume of fluid in whatever ratio has been chosen by the design. In a simple example, assume that the ratio chosen is 13:1. To complete an on-the-fly doubling of the compression ratio, simply hold out one of the two vanes 38. The same device will consequently compress twice the volume on a single revolution and correspondingly the compression ratio will be approximately 26:1. The same method may be used to double the expansion volume. This performance would be delivered in a configuration of one peak 35 and two vanes 38 where only vane 38 is active. On the expansion side, it may be desirable to move from a high performance ratio (e.g. 13:1 in an Otto cycle) to a high efficiency ration (e.g. 26:1 in an Ideal cycle) for sustained cruising. It may also be useful to "over expand" to produce cooling either of the engine itself or of the exhaust signature to meet the goals of stealth aircraft and land vehicles, for example. Therefore, by applying basic thermodynamic principles, the more the fluid is over expanded, the more the fluid cools and the more the fluid cools that which it contacts (i.e., the engine itself).

As the vane 38 exits the working chamber 34, the leading side 40 of the adjacent extended vane 38 in the working chamber 34 pushes the working volume against the stator and rotor peripheral walls 28, 29 as the vane 38 rotates through the working chamber 34 until the exhaust port 46 opens to exhaust the fluid. As the vane 38 pushes against the rotor peripheral wall 29, if the exhaust port 46 remains closed, the working volume decreases, thus compressing the fluid. This is a compression stage. During compression of the fluid, the greater the working volume that can be achieved, based on the number of vanes 38 that are in the retracted position, i.e., creating a larger angular distance between the adjacent vanes 38 in the extended position, the larger the compression ratio that can be achieved. If the exhaust port 46 remains open as the vane 38 continues to move through the working chamber 34, the fluid is exhausted uncompressed. This is an exhaust phase. Therefore, the intake and/or the combustion and the compression and/or the exhaust of the fluid and/or fluid-fuel mixture occur in the same working chamber 34, on opposite sides 40, 42 of the vane 38, respectively.

Figure 14:
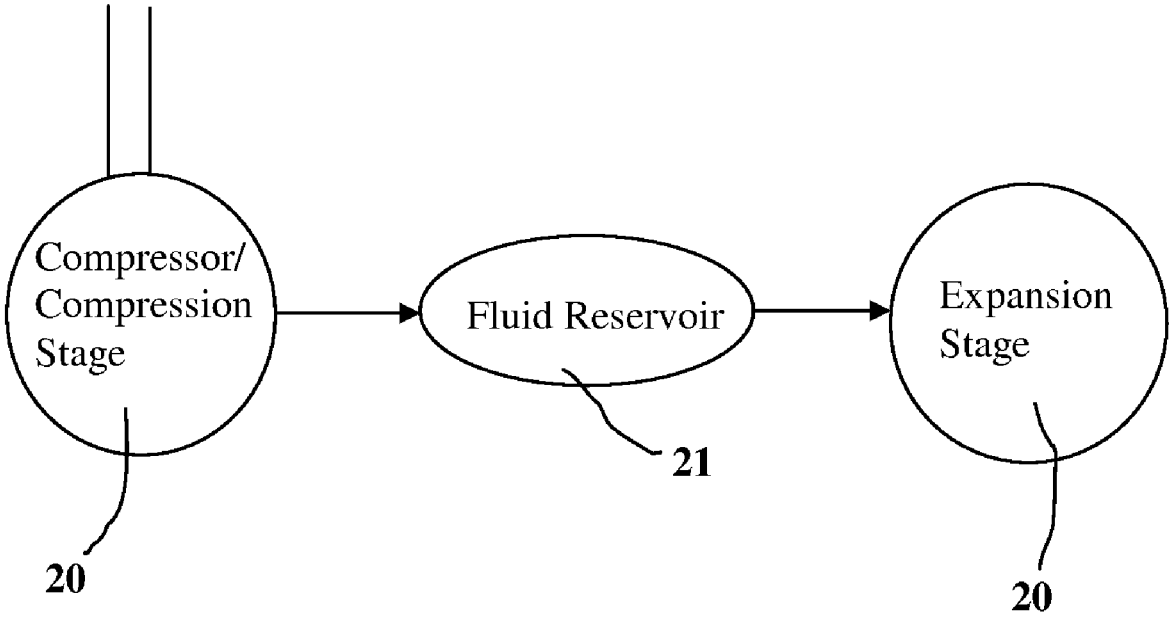
FIG. 14 is a schematic illustrating the logical and physical separation of compressor/compression, fluid reservoir, and combustion/expansion.

The ability to vary the thermodynamic cycle by radially retracting the vanes 38 to increase the working volume is dependent upon the number of working chambers 34 and/or the number of vanes 38. It is possible to select the number of peaks 35 and vanes 38 such that the working volume they control will move the engine performance from the Otto cycle to the Ideal cycle. Additionally, many different performance goals can be met by changing the radius and height of the peripheral walls 28, 29 of the rotor 26 and the stator 24, as well as selecting different numbers of peaks 35 and vanes 38 to meet working volume, speed, and timing requirements. Additionally, all four stages, i.e., intake, compression, expansion and exhaust, do not have to take place in the same rotary device 20, as generally illustrated in FIG. 14. The combustion does not have to be performed within the working chamber of either rotary device 20 and may be performed in a combustion chamber remote from the working chamber. For example, the rotary device 20 may be only a compressor with a variable compression ratio, based on the retraction of the vanes 38. With the fluid compression, the larger the working volume over which the fluid is compressed, the more the fluid will be compressed. Therefore, if a larger compression ratio is desired, a signal is sent to move one or more of the vanes 38 radially against the biasing device 48 to the retracted position inside of the vane pockets 50 to increase the working volume. Alternatively, the rotary device 20 may be only a combustor, i.e., expander, with a variable expansion ratio, based on the retraction of the vanes 38. With the expansion of the fluid as it combusts, the larger the working volume over which the fluid is combusted and expanded, the more the fluid will be expanded. Therefore, if a larger expansion ratio is desired, a signal is sent to move one or more of the vanes 38 radially against the biasing device 48 to the retracted position inside of the vane pockets 50 to increase the working volume.

The compressed fluid may be exhausted to another working chamber 34, into a storage compartment 21 or a fluid reservoir (illustrated in FIG. 14), to another working chamber 34, or to the atmosphere. The expanded fluid is typically exhausted to the atmosphere during the exhaust stage. This design also allows the decoupling of the compression stage, in one rotary device 20, and the expansion stage, in another rotary device 20, so that the compression ratio may be different than the expansion ratio. This directly addresses the inefficiencies of the Otto cycle and related thermodynamic waste and enables the attainment of Ideal cycle performance. The conventional four stroke piston engine reuses the volume of the same cylinder for intake, compression, power, and exhaust. Because work is performed only on the compression and power strokes, the two stroke/cycle engine attempts to clear the spend exhaust gas while refreshing the chamber with a new charge of fresh air while the piston is at or near the bottom of its stroke. This decoupling is accomplished when there is the compressed fluid reservoir 21. Therefore, the work from the compression stage is separated from the work from the expansion stage. The decoupling of the compression stage and the expansion stage means that the compressor pressurizes the compressed fluid reservoir 21 to any desired pressure, via the compression ratio, and maintains that pressure such that the compressed fluid is drawn into the working chamber 34 of the expansion stage. If the compressed fluid is drawn into the working chamber 34 of the expansion stage on demand, it is drawn in at any pressure that is lower than that of the compressed fluid reservoir 21. The compressed fluid reservoir 21 does not have to be a reservoir 21 separate from the working chamber 34 of the compression stage, but can be the working chamber 34 of the compression stage itself.

Additionally, the compression and combustion/expansion characteristics may be adjusted for different types of fuels. The number of vanes 38 that are retracted to increase the working volume and the timing for opening and/or closing the intake and exhaust ports 44, 46 may be varied based on the control signal to vary these characteristics. Such accommodation to the burning characteristics of different fuels which produce both their pollution and propulsion by-products can be identified and accommodated in fixed design features by merely varying the working volume and the timing for opening and/or closing the intake and exhaust ports 44, 46. Market and user demands may also call for on-the-fly adaptation to variable fuel characteristics as dictated by local and regional fuel availability. Therefore, based on calibration, the control signal allows the rotary device 20 to be configured to adapt to variable fuel requirements on-the-fly.

Figure 5:
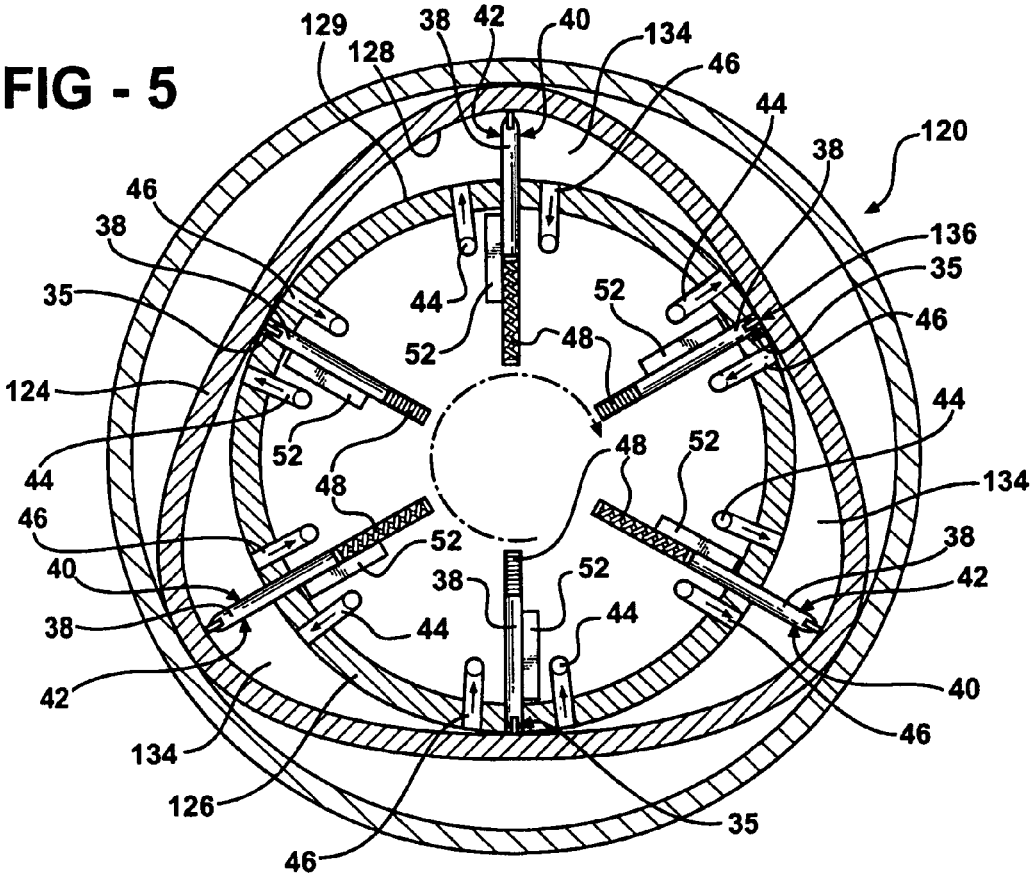
FIG. 5 is a cross-sectional side view of a second embodiment of a rotary device having a rotor and a stator surrounding the rotor with the ports supported by the rotor.
Figure 6:
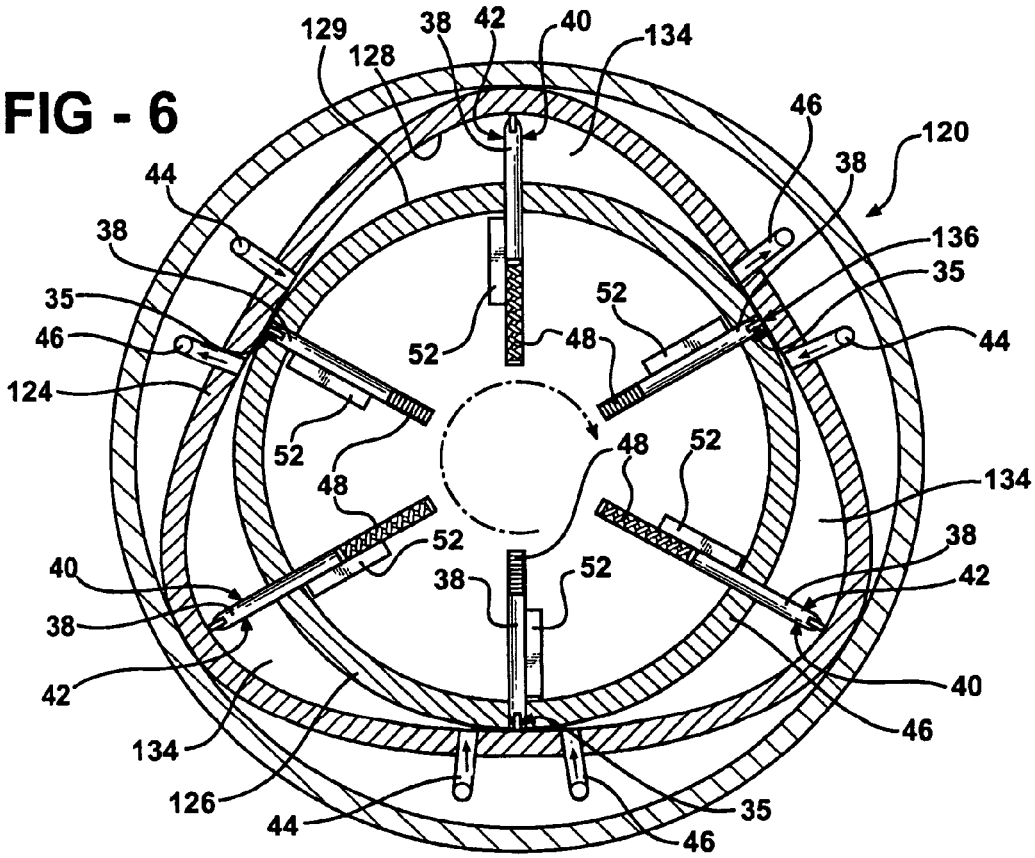
FIG. 6 is a cross-sectional side view of an alternative embodiment of the rotary device shown in FIG. 5 with the ports supported by the stator.

As a second embodiment, a rotary device 120 includes a stator 124 and a rotor 126. Referring generally to FIG. 5, the stator 124 surrounds the rotor 126 on the axis 22. The stator 124 has a stator peripheral wall 128 extending about the axis 22 and a pair of oppositely facing stator side walls 130. The rotor 126 has a pair of rotor side walls 132 in opposition to the stator side walls 130 and a rotor peripheral wall 129 extending about the axis 22 and opposite the stator peripheral wall 128 of the stator 124. The stator 124 includes a cylinder 136 on the axis 22 with the rotor 126 disposed in the cylinder 136 on the axis 22 where the stator walls 128, 130 enclose the rotor 126 inside of the cylinder 136 while allowing the rotor 126 to rotate on the axis 22 in the cylinder 136 relative to the stator 124. The rotor peripheral wall 129 is cylindrical. While the peripheral wall 128 of the stator 124 is generally rounded and having peaks 35, the cylinder 136 in this embodiment is a cylindrical passage, generally defined by the peripheral wall of the stator 124, for receiving the cylindrical rotor 126. The rotor peripheral wall 129 remains in constant rotational contact with each of the peaks 35 of the stator peripheral wall 128. Therefore, the stator walls 128, 130 and the rotor walls 129, 132 cooperate to provide a working chamber 134. The working chambers 134 are the void defined between the stator peripheral wall 128 and the rotor peripheral wall 129 between the adjacent peaks 35. The plurality of vanes 38 are spaced a predetermined angle relative to one another about the axis 22. Each vane 38 is supported for radial movement by the rotor 126 to move radially to maintain sealing contact with the peripheral wall 28 of the stator 124 while also contacting the side walls 130 of the stator 124 during the rotor 126 rotation. Referring to FIG. 5, the intake port 44 and the exhaust port 46 extend through the peripheral wall 28 of the rotor 126. Generally, the intake port 44 is positioned proximate the trailing side 42 of each vane 38 and the exhaust port 46 is positioned proximate the leading side 40 of the vane 38. However, the ports 44, 46 are not limited to being proximate the vanes 38 and can also extend through the peripheral wall 128 of the stator 124, as shown in FIG. 6, inside of the working chamber 134. When the intake port 44 and the exhaust port 46 extend through the peripheral wall 128 of the rotor 126, each port 44, 46 is preferably near opposite ends of the working chamber 134, proximate the peaks 35. The rotor 126 defines the vane pockets 50 for receiving each of the vanes 38 radially in the retracted position and the biasing device 48 is disposed in each of the pockets 50. The actuator 52 connects each of the vanes 38 and the rotor 126.

Figure 7:
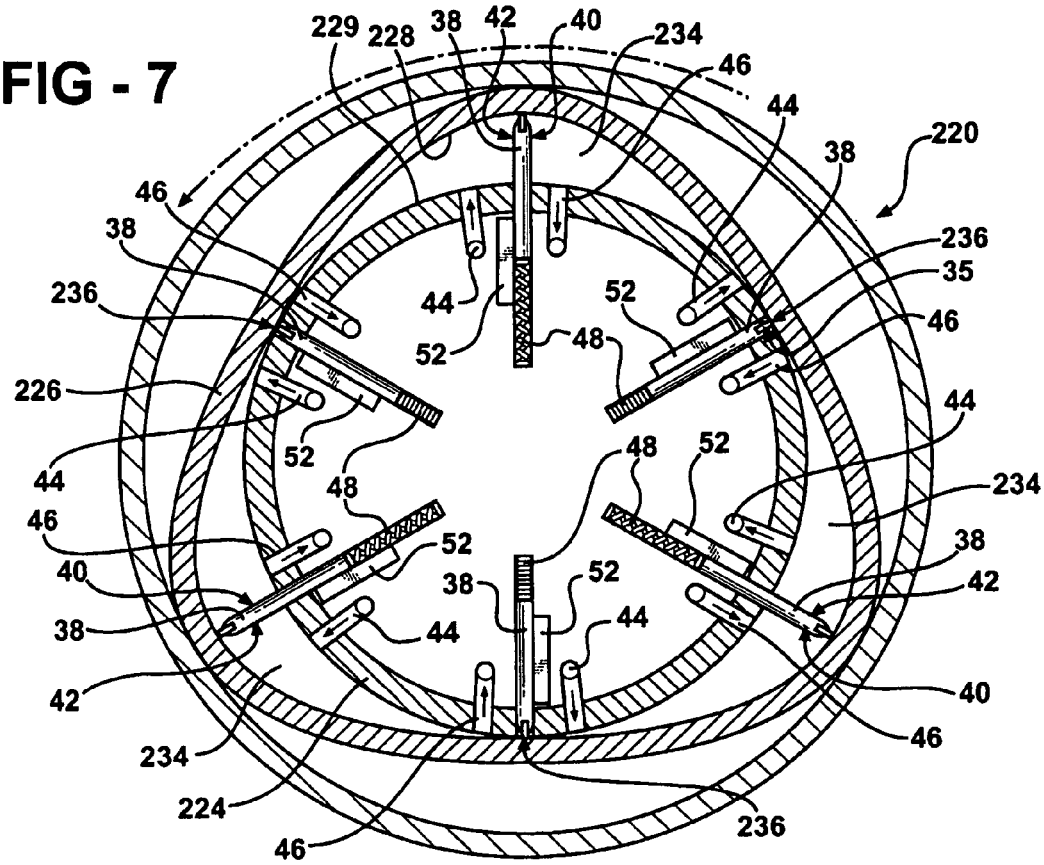
FIG. 7 is a cross-sectional side view of a third embodiment of a rotary device having a stator and a rotor surrounding the stator with the ports supported by the stator.
Figure 8:
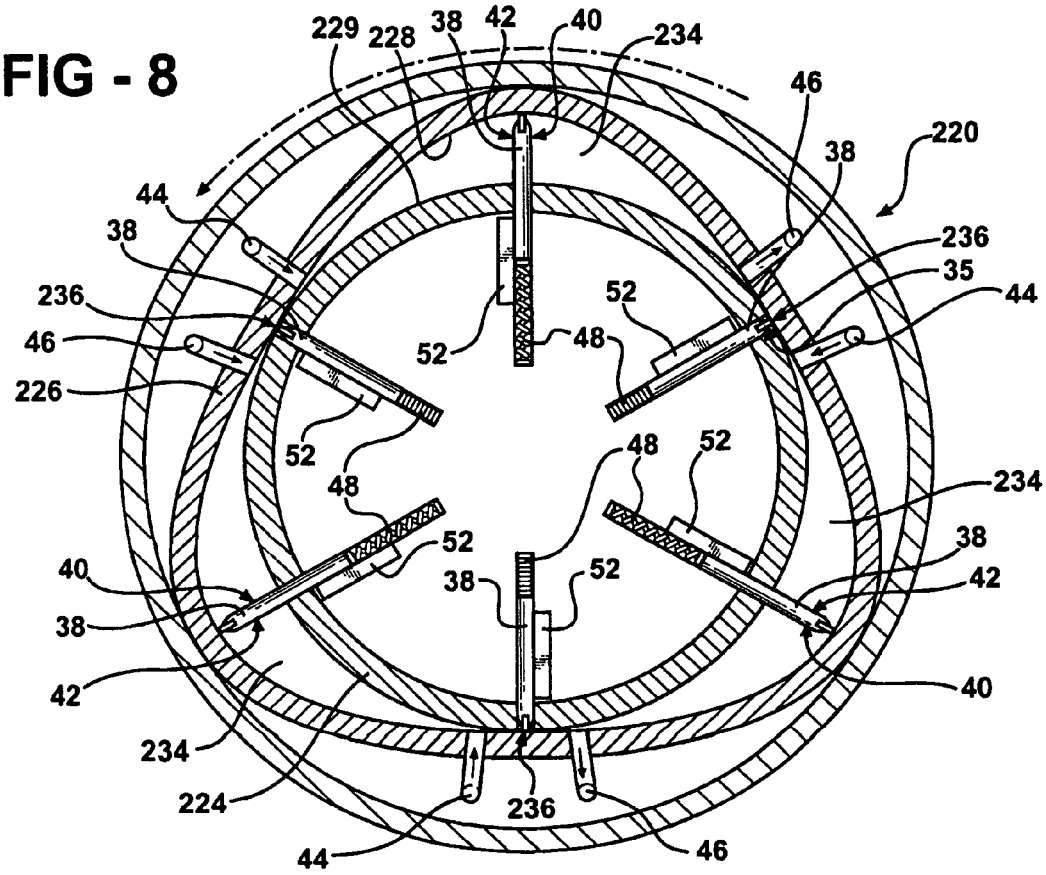
FIG. 8 is a cross-sectional side view of an alternative embodiment of the rotary device shown in FIG. 7 with the ports supported by the rotor.

As a third embodiment, a rotary device 220 includes a stator 224 and a rotor 226. Referring generally to FIG. 7, the rotor 226 surrounds the stator 224 on the axis 22. The stator 224 has a stator peripheral wall 228 extending about the axis 22 and a pair of oppositely facing stator side walls 230. The rotor 226 has a pair of rotor side walls 232 in opposition to the stator side walls 230 and a rotor peripheral wall 228 extending about the axis 22 and opposite the stator peripheral wall 228. The rotor 226 includes a cylinder 236 on the axis 22 with the stator 224 disposed in the cylinder 236 on the axis 22 where the rotor walls 229, 232 enclose the stator 224 inside of the cylinder 236 while allowing the stator 224 to remain stationary in the cylinder 236 with the rotor 226 rotating on the axis 22 relative to the stator 224. The stator peripheral wall 228 is cylindrical. While the peripheral wall 228 of the rotor 226 is generally rounded and having peaks 35, the cylinder 236 in this embodiment is a cylindrical passage, defined by the peripheral wall 228 of the rotor 226, for receiving the cylindrical stator 224. The stator peripheral wall 228 remains in constant contact with each of the peaks 35 of the rotor peripheral wall 229. The stator walls 228, 230 and the rotor walls 229, 232 cooperate to provide a working chamber 234. The working chambers 234 are the void defined between the stator peripheral wall 228 and the peripheral wall 228 of the rotor 226 between the adjacent peaks 35. The plurality of vanes 38 are spaced a predetermined angle relative to one another about the axis 22. Each vane 38 is supported for radial movement by the stator 224 to move radially to maintain sealing contact with the peripheral wall 228 of the rotor 226 while also contacting the side walls 232 of the rotor 226 during rotor 226 rotation. Referring to FIG. 7, the intake port 44 and the exhaust port 46 extend through the stator peripheral wall 228. Generally, the intake port 44 is positioned proximate the trailing side 42 of each vane 38 and the exhaust port 46 is positioned proximate the leading side 40 of the vane 38. However, the ports 44, 46 are not limited to being proximate the vanes 38 and can also extend through the peripheral wall 228 of the rotor 226, as shown in FIG. 8, inside of the working chamber 234. When the intake port 44 and the exhaust port 46 extend through the peripheral wall 228 of the rotor 226, each port 44, 46 is preferably near opposite ends of the working chamber 234. The stator 224 defines the vane pockets 50 for receiving each of the vanes 38 radially in the retracted position and the biasing device 48 is disposed in each of the pockets 50. The actuator 52 connects each of the vanes 38 and the stator 224.

Figure 9:
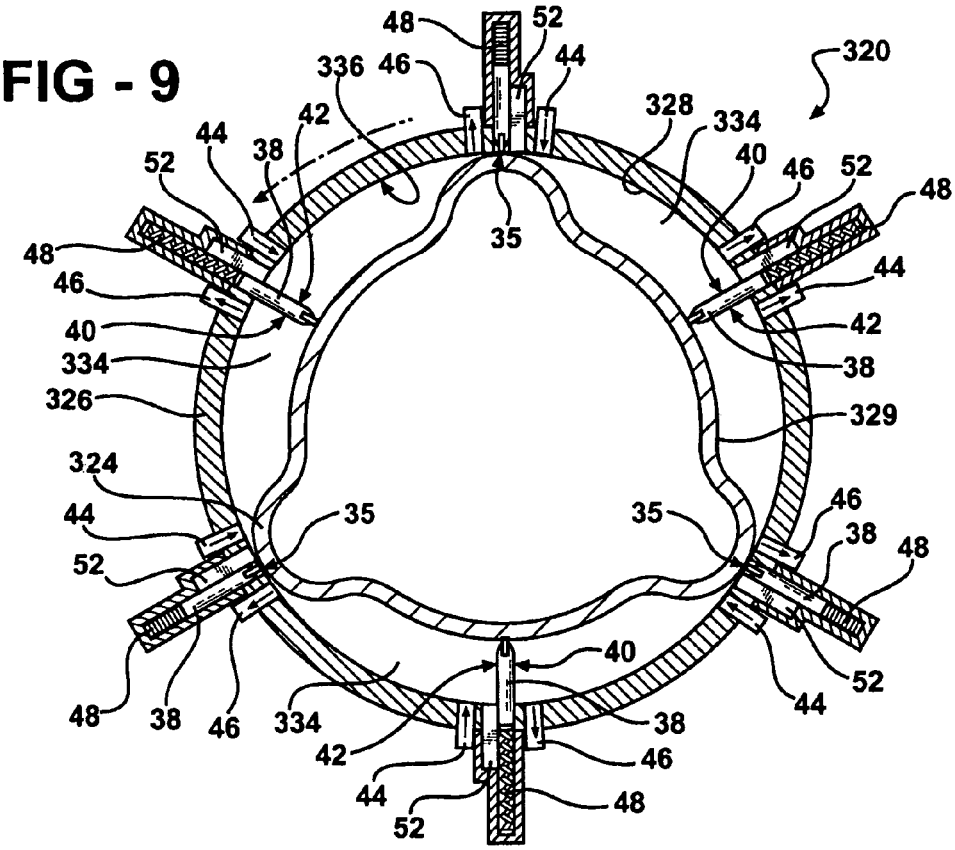
FIG. 9 is a cross-sectional side view of a fourth embodiment of a rotary device having a stator and a rotor surrounding the stator with the ports supported by the rotor.
Figure 10:
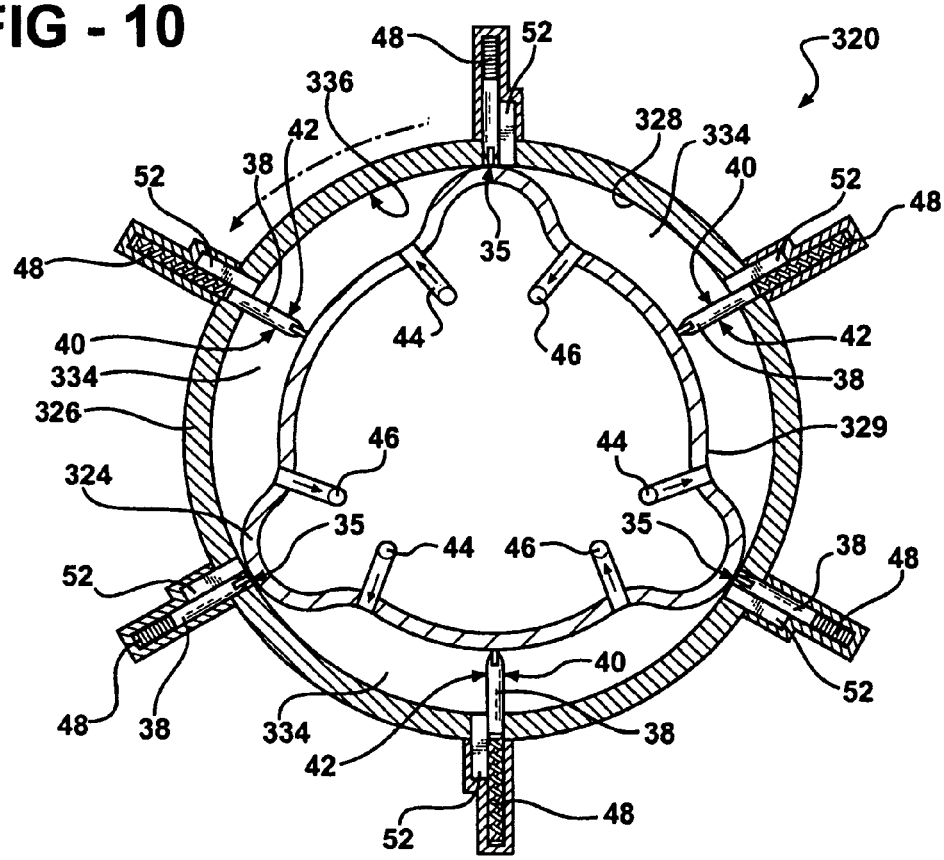
FIG. 10 is a cross-sectional side view of the an alternative embodiment of the rotary device shown in FIG. 9 with the ports supported by the stator.
Figure 11:
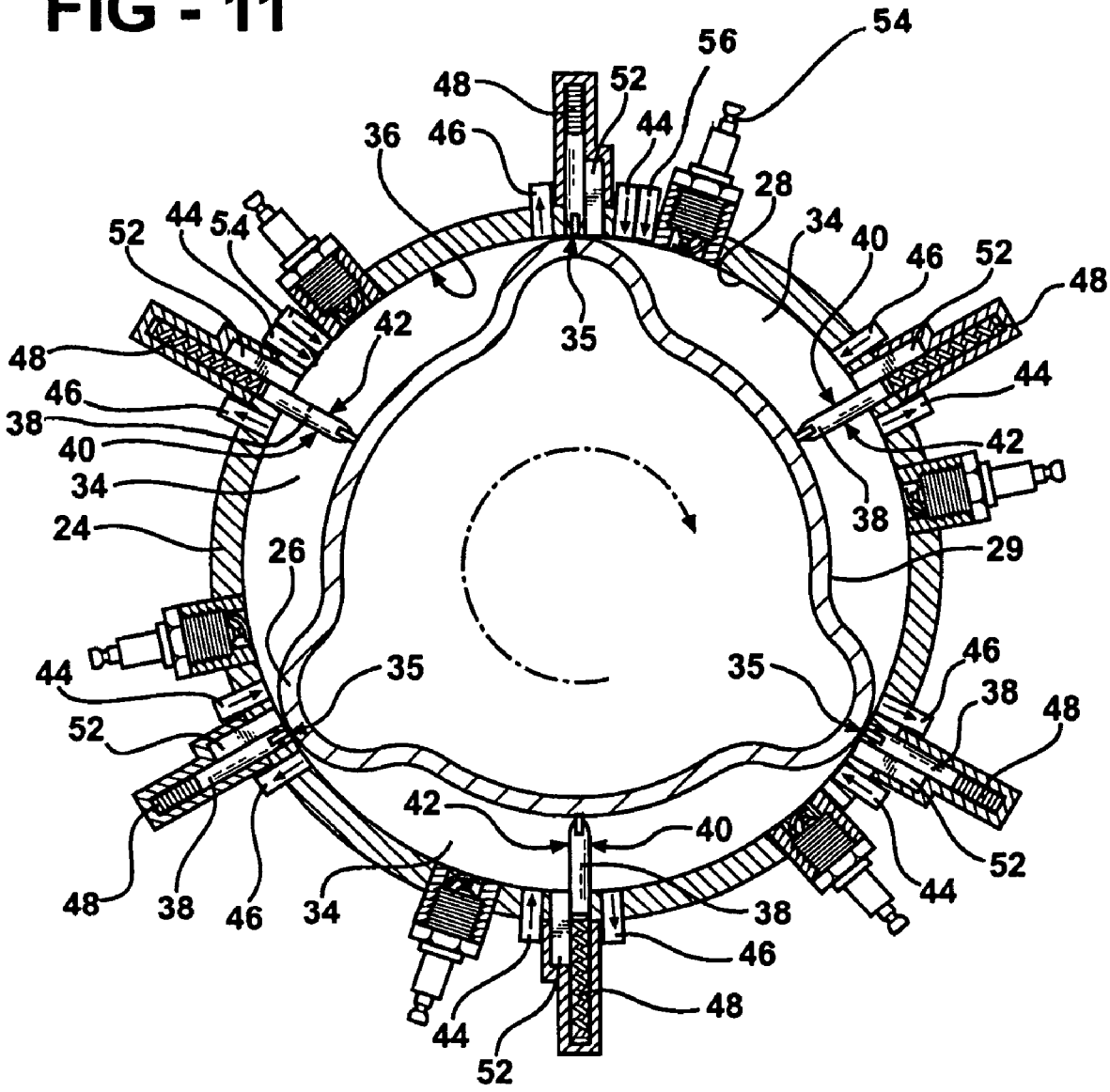
FIG. 11 is a partial cross-sectional side view of a rotary device including an ignition source.

As a fourth embodiment, a rotary device 320 includes a stator 324 and a rotor 326. Referring generally to FIG. 9, the rotor 326 surrounds the stator 324 on the axis 22. The stator 324 has a stator peripheral wall 328 extending about the axis 22 and a pair of oppositely facing stator side walls 330. The rotor 326 has a pair of rotor side walls 332 in opposition to the stator side walls 330 and a rotor peripheral wall 329 extending about the axis 22 and opposite the stator peripheral wall 328. The rotor 326 includes a cylinder 336 on the axis 22 with the stator 324 disposed in the cylinder 336 on the axis 22 where the rotor walls 329, 332 enclose the stator 324 inside of the cylinder 336 while allowing the stator 324 to remain stationary in the cylinder 336 with the rotor 326 rotating on the axis 22 relative to the stator 324. The peripheral wall 328 of the rotor 326 is cylindrical. The peripheral wall 328 of the stator 326 is generally rounded and has peaks 35. The stator peripheral wall 328 remains in constant contact with each of the peaks 35 of the rotor peripheral wall 329. The stator walls 328, 330 and the rotor walls 329, 332 cooperate to provide a working chamber 334. The working chambers 334 are the void defined between the stator peripheral wall 328 and the peripheral wall 328 of the rotor 326 between the adjacent peaks 35. The plurality of vanes 38 are spaced a predetermined angle relative to one another about the axis 22. Each vane 38 is supported for radial movement by the stator 324 to move radially to maintain sealing contact with the stator peripheral wall 328 while also contacting the side walls 332 of the rotor 326 during rotor 326 rotation. Referring to FIG. 9, the intake port 44 and the exhaust port 46 extend through the peripheral wall 328 of the rotor 326. Generally, the intake port 44 is positioned proximate the trailing side 42 of each vane 38 and the exhaust port 46 is positioned proximate the leading side 40 of the vane 38. However, the ports 44, 46 are not limited to being proximate the vanes 38 and can also extend through the peripheral wall 328 of the stator 324, as shown in FIG. 10, inside of the working chamber 334. When the intake port 44 and the exhaust port 46 extend through the peripheral wall 328 of the stator 324, each port 44, 46 is preferably near opposite ends of the working chamber 334, proximate the adjacent peaks 35. The rotor 326 defines the vane pockets 50 for receiving each of the vanes 38 radially in the retracted position and the biasing device 48 is disposed in each of the pockets 50. The actuator 52 connects each of the vanes 38 and the rotor 326.

As another configuration, the compression stage and the expansion stage are arranged either concentrically, i.e., radially stacked, or side-by-side, i.e., ganged. A conventional transmission, e.g., geared or continuously variable, are used to control the relationship between the demands of the compression stage and the expansion stage. Alternatively, a rod with contact wheels is employed to route a positive mechanical transmission around the axis 22 of the rotor 26. In other words, by increasing the number of revolutions of the compression stage in relation to the expansion volume of the expansion stage, it is possible to supercharge the fluid into the expansion stage. Correspondingly, without changing anything in the working chambers 34 of the expansion stage, the thermodynamic characteristics of the expansion stage will shift back from the Ideal cycle behavior toward the characteristics of the Otto cycle. This changes the performance from high fuel efficiency, i.e., Ideal cycle, to high performance, i.e., Otto cycle.

Arranging the rotary devices 20 by either radially stacking or ganging, provides several advantages. By extending radially, rather than along the axis, increases the power. Also, the pressure gradient between rotors is reduced when the rotors are stacked radially. Just like the axial flow compressors used in turbine engines, the inter-stage losses will be reduced and the end-to-end pressure differential can be increased. This will be more important to challenge Brayton cycle engines. Additionally, this allows the rotary devices 20 to be used as a multi-stage compressor or a multi-stage expansion device.

Additionally, a four-wheel-drive vehicle may be implemented using four separate rotary devices 20 at lower cost and weight than the present single-engine vehicles that utilize a transmission and a transfer case to distribute the power to the four wheels. In this application, the rotary devices 20 are at each of the four wheels of a vehicle. Ideally, the rotary devices 20 become integral to each wheel, where the rotor 26 includes the cylinder 36 and the stator 24 is disposed inside of the cylinder 36. A tire is mounted to the exterior of the rotor 26 and the stator 24 is connected to the vehicle. However, this should not be limited to a four-wheel-drive vehicle as this can be applied to any number of one or more wheels of the vehicle.

As yet another configuration, the working chambers 34 for the compression stage and the expansion stage are concentric with respect to one another around the axis 22. Alternatively, the rotors 26 for the compression stages and expansion stages are adjacent and rotate in opposite directions on the same axis 22. These allow for neutralizing the angular momentum of the rotors 26 for the compression stage and the expansion stage, thereby eliminating angular momentum and gyroscopic problems that are typical in aerospace applications. The side by side placement of two rotors 26, linked and turning in opposite directions around a central stator 24, would deliver a simplified propulsion system for counter-rotating propellers, i.e., fan jets. Acknowledged aerodynamic efficiencies of this approach have been thwarted in implementations by high parts counts, manufacturability and reparability costs. Control and maneuverability problems resulting from angular momentum in conventional aircraft engines is eliminated. Gyroscopic problems dictating tail rotor in helicopters are also eliminated.

The uses of the rotary devices 20 are not limited to replacing the traditional internal combustion engine. Rather, the rotary devices 20 may also be used for a starter motor, an electric drive motor, regenerative braking, a hybrid engine, a generator, and a battery charger. Embedding of the starter motor may be designed into any stage with benefits in the elimination of parts and increased torque by the starter motor. Enhancement of the starter motor would result from embedding the electric drive motor as a hybrid supplement to the combustion engine. Additionally, the starter motor would be enhanced by embedding the generator, both for regenerative braking and for recharging of a battery by the combustion in the hybrid application. Combining the starter, drive, and generator is either conventionally commutated, i.e., using wound wire rotor 26 and stator 24, or by permanent magnets, i.e., without commutation, depending on the location with respect to heat. For example, the outermost rotor 26 may be designed to be the coolest first compressor stage if this is the variable governing an optimized solution. The outermost rotor 26 is also the highest torque location which is most desirable for combustion output as well as generator output so that an optimized solution may dictate wound wire rather than permanent magnets. Additionally, solid state or other materials may replace wire wound components of the motor and/or the generator. However, the invention is not limited to these applications and can include other devices and uses as well.

The simplicity of constructing the rotary device 20 allows for many manufacturing benefits. By implementing polished surface tolerances, the need for lubrication is reduced or eliminated. Polished surface tolerances are delivered by roll formed metal components which replace traditional metal castings, including any contours of the components. The size, weight, overall system dimensions are reduced. Excess casting weight due to designed-in pouring path and porosity prevention are eliminated. Using precision, in place of extra materials and lubrication, eliminates the major seal issues typical with traditional rotary devices 20. The components are manufactured from cold mill surface finishing and hardening. For example, the stator side walls 30 and the rotor side walls 32 may be stamped to a shape that matches the desired contour for the associated peripheral wall 28, 29. The side walls 30, 32 and working chamber 34 surfaces may be stamped or cut from rolled metals, or other similar materials. Contoured components of corresponding shape and finish precision are conveniently formed as ceramics, as extruded metal such as aluminum, injected with amorphous metals, or cut by wire and other Electronic Discharge Machining (EDM) processes. The peripheral wall 28, 29 is then attached to the perimeter of the associated side wall 30, 32. The process for attaching the perimeter of the side wall 30, 32 to the associated peripheral wall 28, 29 may use electron beam and laser welding of the of the primary working surface and housings to provide zero deformation and therefore precision sealing between all of the components in the rotary device 20 during rotor 26 rotation. Precise cold insertion or equivalent low deformation insertion of a central bearing before cutting outer diameters of the rotor 26 and/or stator 24 assures concentricity and balance between the rotor 26 and the stator 24. Final grinding or polishing of the outer diameters assures close tolerances before mating of the stator 24 to the rotor 26. To reduce erosion, deformation, and corrosion in "hot zones," the selective use of ceramics, especially as inserts, may be employed. Additionally, the hot zones may be sprayed and protected from wear by designing a separate wall to run the vanes 38 on a path chosen for other purposes than following the stator peripheral wall 28 or the rotor 26. For example, the retraction of the vanes 38 to increase the expansion. Use of surface hardening by selective methods focused on specific areas, e.g., laser, such as impact zones rather than by more costly treatment of entire parts or use of more costly materials may also be employed.

The rotary device 20 also allows for "scalability". Accordingly, the components of the rotary devices 20 can be manufactured to meet the output performance requirements. For example, rotor 26 diameter, rotor 26 width, and working chamber 34 height can be manufactured to meet the output performance requirements. Additionally, the total number of rotors 26 that are ganged along the axis 22, or radially stacked, are varied upon manufacturing to meet the output performance requirements. Therefore, the size ranges from the largest of aircraft engines, locomotives, and stationary power applications down to golf-ball sized miniature versions and even sub-miniaturized applications.

Plasma injection may be delivered through the generation of high voltage direct current or static electricity, both of which may be produced readily within the package and without adding moving parts. A needle shaped valve is pulsed by magnetostriction or other microelectronic mechanical system (MEMS) to open a fuel passage through an insulating seat into the working chamber 34.

Redundant Array of Inexpensive Drives (RAID) implementation would include hovercraft, VTOL aircraft, hydroplanes, and combat airframes. A number of gimbaled engines are distributed in a desired pattern around the periphery of an arbitrary shape, e.g., flying saucer or bus. Computerized control of aerodynamically unstable shapes, e.g., F-117, would accommodate reliability considerations such as the loss of one or more engines in military combat. RAID redundancy is also useful in civilian applications where the protection of passenger lives is important. Beyond RAID for safety benefits in a conventional civilian commercial context, this rotary device 20 invites a variety of multi-engine, even personal aircraft, ranging in capabilities from urban hovercraft to long range high-speed vertical take-off and landing (VTOL). With the capability to precisely maintain a stationary position, it is possible to manage a three-dimensional traffic grid using GPS and computerized route control of all vehicles in a matrix. Perhaps the most important practical consideration for success in high density urban settings is the ability to reduce or eliminate exhaust noise by varying the temperature and pressure at which the spent fluid-fuel mixture exhausts. Control of the RAID may be distributed using capabilities of the engine controller itself or augmented capabilities built either within the same computer chip or by simply adding and coordinating within a standardized engine controller shell. Further, rather than to rely on a central computer system which would itself present a single point of failure, the Electronic Engine Control (EEC) subsystem itself is augmented with supervisory functions built on either a distributed voting model or a swarm paradigm. The performance and resilience of the RAID would be significantly advance by defining the capability of member drives to include their ability to recognize the number of other drives in the community and to relate appropriately in relation to the number of survivors in the array. Significant capabilities would accrue from the exchange of information alone replacing significant costs in alternative subsystem implementations.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

What is claimed is:

1. A method of manipulating a fluid by decoupling the respective compression and expansion ratios between a first working chamber and a second working chamber where the first and second working chambers communicate with one another through a common fluid passage, each working chamber of the type provided by at least one rotary device having a stator and a rotor rotatable with respect to the stator about an axis to manipulate the fluid where the rotor and the stator cooperate to provide the working chambers, said method comprising the steps of;

rotating the rotor to admit a first quantity of fluid into the first working chamber at an inlet pressure and then altering the volume of the first quantity of fluid within the first working chamber by a first compression or expansion ratio to establish a first fluid pressure that is different than the inlet pressure, delivering the quantity of fluid at the first fluid pressure from the first working chamber to the common fluid passage as the rotor rotates, rotating the rotor to admit a quantity of fluid into the second working chamber from the common fluid passage at a second fluid pressure and then altering the volume of the second quantity of fluid within the second working chamber by a second expansion or compression ratio to establish an outlet fluid pressure that is different than the second fluid pressure, providing controlled and intermittent fluid communication between the common fluid passage and the second working chamber to charge the second working chamber with the quantity of fluid at the second fluid pressure, and storing the fluid delivered from the first working chamber in the fluid reservoir to establish the stored fluid pressure therein varying the first compression or expansion ratio relative to the second expansion or compression ratio simultaneously with said steps of rotating the rotor to achieve on-the-fly changes in a thermodynamic cycle utilizing the fluid.

2. A method as set forth in claim 1 wherein the second fluid pressure is less than the first fluid pressure.

3. A method as set forth in claim 1 wherein the second fluid pressure is greater than the first fluid pressure.

4. A method as set forth in claim 1 wherein the rotary device includes a plurality of vanes supported for radial movement on one of the stator and the rotor with the rotor and the stator and the adjacent vane cooperating to define a first working volume within the first working chamber and a second working volume within the second working chamber and further including the step of moving at least one of the vanes radially to a retracted position to increase one of the first and second working volumes between the rotor and the stator and the adjacent vane.

5. A method as set forth in claim 4 wherein said step of moving at least one of the vanes to increase the working volume is further defined as moving at least one of the vanes radially to a retracted position.

6. A method as set forth in claim 4 wherein said step of moving at least one of the vanes to increase the working volume is further defined as moving at least one of the vanes radially to a retracted position to increase the working volume between the vane entering the one of the first and second working chambers and the rotor and the stator as the rotor rotates and before the next adjacent vane enters the working chamber to vary the pressure ratio and compress the fluid in the working chamber.

7. A method as set forth in claim 1 wherein the step of providing controlled and intermittent fluid communication between the common fluid passage and the second working chamber is further defined as delivering a controlled volume of the fluid from the fluid reservoir to the second working chamber to deliver a controlled mass flow of fluid into the second working chamber.

8. A method as set forth in claim 1 wherein the step of providing controlled and intermittent fluid communication between the common fluid passage and the second working chamber is further defined as delivering the fluid from the common fluid passage to the second working chamber at a controlled pressure to deliver a controlled mass flow of fluid into the second working chamber.

9. A method as set forth in claim 1 further including the step of delivering the fluid from the second working chamber to the common fluid passage as the rotor rotates to store the fluid for reuse in one of the first and second working chambers.

10. A method as set forth in claim 1 further including the step of delivering the fluid from the second working chamber to outside atmosphere as the rotor rotates.

11. A method as set forth in claim 1 further including the step of combusting the fluid in a combustion chamber.

12. A method as set forth in claim 11 further including the step of delivering the fluid to a combustion chamber remote from each of the working chambers prior to delivering the fluid to the second working chamber.

13. A method as set forth in claim 11 wherein the combustion chamber is further defined as one of the working chambers and the step of combusting the fluid is further defined as combusting the fluid in one of the first and second working chambers.

14. A method as set forth in claim 12 wherein the step of combusting the fluid is further defined as combusting the fluid in the second working chamber.

15. A method as set forth in claim 1 wherein the first working chamber is provided within a first rotary device and the second working chamber is provided within a second rotary device and said step of rotating the rotor to admit a first quantity of fluid is further defined as rotating the rotor of the first rotary device at a first rotational speed to establish the volume of the first quantity of fluid within the first working volume and said step of rotating the rotor to admit a second quantity of fluid is further defined as rotating the rotor of the second rotary device at a second rotational speed to alter the volume of the second quantity of fluid within the second working volume, different from the first rotational speed.

16. A method as set forth in claim 15 wherein the quantity of the first fluid is equal to the quantity of the second fluid and said step of rotating the rotors is further defined as rotating the first rotor at the first rotational speed and rotating the second rotor at the second rotational speed less than the first rotational speed.

17. A method as set forth in claim 15 wherein the quantity of the first fluid is equal to the quantity of the second fluid and said steps of rotating the rotors is further defined as rotating the first rotor at the first rotational speed and rotating the second rotor at the second rotational speed greater than the first rotational speed.

18. A method as set forth in claim 15 wherein one of the first and the second rotary devices include a plurality of vanes supported for radial movement on one of the stator and the rotor with the rotor and the stator and the adjacent vane cooperating to define a working volume within the respective working chamber and further including the step of moving at least one of the vanes radially to a retracted position to increase the working volume between the rotor and the stator and the adjacent biased vane to vary the first compression or expansion ratio relative to the second expansion or compression ratio.

19. A method as set forth in claim 15 further including an intake port opening from the common fluid passage to the second working chamber and said step of providing controlled and intermittent fluid communication is further defined as manipulating the intake port in response to a control signal to manage the fluid flowing into the second working chamber.

20. A method as set forth in claim 19 wherein said step of manipulating the intake port is further defined as manipulating the intake port to manage the quantity of fluid entering the second working chamber from the common fluid passage.

21. A method as set forth in claim 19 wherein said step of manipulating the intake port is further defined as manipulating the intake port to manage the pressure of the fluid entering the second working chamber from the common fluid passage.

22. A method as set forth in claim 15 wherein the step of rotating the rotor of the first rotary device is further defined as rotating the rotor of the first rotary device to compress the fluid to the first fluid pressure and the step of rotating the rotor of the second rotary device is further defined as rotating the rotor of the second rotary device to expand the fluid to the second fluid pressure.

23. A method as set forth in claim 15 wherein the step of rotating the rotor of the first rotary device is further defined as rotating the rotor of the first rotary device to expand the fluid to the first fluid pressure and the step of rotating the rotor of the second rotary device is further defined as rotating the rotor of the second rotary device to expand the fluid to the second fluid pressure.

24. A method as set forth in claim 15 wherein the step of rotating the rotor of the first rotary device is further defined as rotating the rotor of the first rotary device to compress the fluid to the first fluid pressure and the step of rotating the rotor of the second rotary device is further defined as rotating the rotor of the second rotary device to compress the fluid to the second fluid pressure.

25. A method as set forth in claim 15 wherein the step of rotating the rotor of the first rotary device is further defined as rotating the rotor of the first rotary device to expand the fluid to the first fluid pressure and the step of rotating the rotor of the second rotary device is further defined as rotating the rotor of the second rotary device to compress the fluid to the second fluid pressure.

26. A method as set forth in claim 15 further including the step of delivering the fluid from the second working chamber to the common fluid passage as the rotor rotates to store the fluid for reuse in one of the first and second working chambers.

27. A method as set forth in claim 15 further including the step of retaining the fluid in one of the first and second rotary device to retard rotor rotation and brake the rotor.

28. A rotary system comprising;

a first rotary device on a first axis including a stator extending about said first axis and a rotor rotatable with respect to said stator, said rotor and said stator of said first rotary device cooperating to define a working volume therebetween with said working volume changing by a first compression or expansion ratio as said rotor is rotated with respect to said stator, an exhaust port extending into said first rotary device for periodically opening to said working volume to exhaust the fluid from said first rotary device at a first pressure, a second rotary device on a second axis including a stator extending about said second axis and a rotor rotatable with respect to said stator, said rotor and said stator of said second rotary device cooperating to define a working volume therebetween with said working volume changing by a second expansion or compression ratio as said rotor is rotated with respect to said stator, an intake port extending into said second rotary device for periodically opening to said working volume to deliver the fluid into said second rotary device at a second pressure, and a common fluid passage interconnecting said exhaust port of said first rotary device and said intake port of said second rotary device for receiving the fluid received from said exhaust port of said first rotary device at the first pressure and transmitting the fluid into said intake port of said second rotary device at the second pressure; and means for varying the first compression or expansion ratio relative to the second expansion or compression ratio to decouple the thermodynamic cycle of said first rotary device from said second rotary device on-the-fly.

29. A rotary system as set forth in claim 28 wherein one of said rotor and said stator further comprising a plurality of vanes spaced a predetermined angle relative to one another about said axis of said respective rotary device with said rotor and said stator and said adjacent vane cooperating to define a working volume therebetween and with each vane supported for radial movement by one of said stator and said rotor to move radially to maintain sealing contact with said other one of said stator and said rotor during said rotor rotation and each of said vanes are selectively biased against a biasing device from the sealing position to a retracted position to increase the working volume of one of the first and the second rotary device.

30. A rotary system as set forth in claim 29 further including an actuator for moving each of said vanes of one of said first and said second rotary device radially against said biasing device to said retracted position and a control system for sending a control signal for sending a signal to each of said actuators to selectively move each of said vanes radially.

31. A rotary system as set forth in claim 28 wherein said first and said second axes are aligned along a common axis.

32. A rotary device as set forth in claim 31 wherein said second rotary device is concentric with and rotatable with respect to said first rotary device.

33. A rotary device as set forth in claim 31 wherein said first and said second rotary devices are adjacent.

34. A rotary system as set forth in claim 31 wherein said first and said second rotary devices rotate in opposite directions.

35. A rotary system as set forth in claim 31 wherein said first and said second rotary devices rotate in the same direction.

36. A rotary system as set forth in claim 28 wherein one of said intake and exhaust ports of said first and said second rotary device open in response to a predetermined pressure of said working volume.

37. A rotary system as set forth in claim 28 wherein one of said intake and exhaust ports of said first and said second rotary devices open in response to a radial position of said vanes.

38. A rotary system as set forth in claim 28 wherein one of said intake and exhaust ports of said first and said second rotary devices open in response to a control signal and exhaust ports of said first and said second rotary devices open in response to an angular position of said vanes.

39. A rotary system as set forth in claim 28 wherein one of said intake and exhaust ports of said first and said second rotary device open in response to an angular position of said vanes.

40. A rotary system as set forth in claim 28 wherein at least one of said intake and said exhaust ports are a shuttle valve.

41. A rotary system as set forth in claim 28 further including a combustion chamber disposed between said inlet of said second rotary device and said common fluid passage for combusting the fluid received from the said common fluid passage.

* * * * *